US005377663A

United States Patent [19]

Cole et al.

[11] Patent Number: 5,377,663

[45] Date of Patent: Jan. 3, 1995

[54] GRATE COMBUSTION SYSTEM

[75] Inventors: Arthur W. Cole, Rowley, Mass.; Franklin A. Hamlyn, Hampton, N.H.; James D. Dougherty, Stamford, Conn.; John M. O'Sullivan, Stony Point, N.Y.

[73] Assignee: Wheelabrator Environmental Systems, Inc., Hampton, N.H.

[21] Appl. No.: 71,994

[22] Filed: Jun. 7, 1993

[51] Int. Cl.[6] ..... F23H 13/00

[52] U.S. Cl. ..... 126/152 B; 110/281; 110/298; 126/152 R; 126/163 R; 126/175

[58] Field of Search ..... 126/152 R, 163 R, 160, 126/174, 175, 152 A, 152 B; 110/281, 297, 298

[56] References Cited

U.S. PATENT DOCUMENTS

| | | | |
|---|---|---|---|
| 3,651,770 | 3/1972 | Hotti | 110/257 |
| 3,871,287 | 3/1975 | Spillman et al. | 110/328 |
| 3,934,521 | 1/1976 | Andreoli | 110/226 |
| 4,018,168 | 4/1977 | Andreoli et al. | 110/268 |
| 4,239,029 | 12/1980 | Martin et al. | 126/153 R X |
| 4,463,688 | 8/1984 | Andreoli | 110/298 |
| 4,582,193 | 4/1986 | Larsson | 198/803.01 |
| 4,596,233 | 6/1986 | Hyde et al. | 126/152 B X |
| 5,004,097 | 4/1991 | Roinestad et al. | 198/803.01 |
| 5,205,100 | 4/1993 | Lecointre | 126/152 B X |
| 5,259,362 | 11/1993 | Krieger | 126/175 |

*Primary Examiner*—Edward G. Favors

*Attorney, Agent, or Firm*—Banner, Birch, McKie & Beckett

[57] ABSTRACT

The sidewall end grate block includes a first side which can be placed adjacent to a press plate and a second side which is adjacent to another grate block. The first side includes press plate attachment provisions while the second side includes a tension rod attachment provisions. The press plate attachment provisions on the first side include a plurality of holes which are adapted to receive bolts which can be received by a corresponding holes in the respective adjacent press plate. The tension rod attachment provisions on the second side include a cross-shaped hole and locking protrusions which can accept the head end of a tension rod.

11 Claims, 15 Drawing Sheets

148
154
156
148
154

152
156
154

148
144
112
142
146

150
146
142
146
142

150
156
112
156

GRATE COMBUSTION SYSTEM

FIELD OF THE INVENTION

The present invention relates to incinerators, and more particularly to the grate combustion system of an incinerator such as those which use refuse as a fuel source and typically generate steam for electrical power generation. Particular aspects of the grate combustion system addressed are improvements in grate block designs, side end wall grate block design, grate tension rod design, grate side seal design and grate roof element design which provide improvements in efficiency, interchangeability and/or maintenance reduction.

BACKGROUND OF THE INVENTION

The need to provide environmentally correct and cost effective solutions for the refuse generated in the Unites States became apparent in the late 1960's. At that time, refuse disposal was mainly by land filling and to a lesser extent incineration. It was recognized that landfill space was a finite resource and that refuse itself was an inherent fuel resource that could be utilized to displace other more costly fuel sources in the generation of process steam and electricity.

A refuse to energy plaint is composed of several separate and distinct areas. These include: (1) refuse receiving, handling and storage; (2) refuse combustion; (3) heat recovery and electrical generation; and (4) environmental control. The refuse combustion system is of particular interest herein and it typically is composed of the following: (1) refuse feed hopper and chute, (2) ram feeder, (3) grate combustion system, (4) lower furnace combustion zone, and (5) grate ash discharge system. Current conditions require that these systems operate over extended periods of time with limited maintenance. Initial operating results for these types of facilities exhibited extensive maintenance and downtime.

Refuse is introduced to the grate combustion system via a charging hopper and feed chute. Typically, a crane, or in some cases, a front end loader picks up a quantity of refuse from the site receiving and storage area and deposits it into the charging hopper. This charging hopper has a large plan area to facilitate this operation and acts as a funnel to feed the refuse to the feed chute. The feed chute typically is rectangular in cross section and has slightly divergent sides. The width of the feed chute approximates the width of the grate to facilitate uniform refuse fuel flow across the unit. The feed chute and the lower part of the charging hopper are always kept full of refuse to maintain a seal between the combustion zone within the furnace enclosure and ambient. i.e. the exterior of the furnace enclosure.

Refuse from the feed chute exits to a flat, table top surface, directly below. This surface provides a staging area for the refuse to move out onto the grate in a controlled manner beginning the combustion process. A ram feeder, which is a plow-type device, operates on top of this table and is hydraulically driven at a predetermined speed to push the refuse onto the grate. The feeder is considered a volumetric flow controller as it pushes a volume of refuse equal to its height by the plan area of the feed chute discharge opening. The feeding portion of the unit involves the group operation of several parallel ram feeders across the full width of the grate system to insure equal fuel loadings across the unit. Accordingly, refuse is pushed off the table and onto the grate system to start the combustion process within the furnace enclosure. Drying and ignition of the refuse occurs a short distance downstream on the grate system.

The grate system in a refuse fired furnace provides the necessary support of the refuse fuel bed while being transported through the combustion sequence. In order for satisfactory combustion to occur, air must be supplied from below the fuel bed and be equally distributed across the width of the grate system and depth of the fuel bed in the unit. This combustion air also provides the cooling of the grate system necessary to maintain its integrity.

Typically, the grate system is a forward moving reciprocating-type with the grate blocks each inclined at an angle of 18 degrees from the horizontal and with alternating transverse rows (relative to the direction of refuse flow) of stationary and reciprocating grate blocks. Each row of grate blocks overlaps the row ahead of it to provide the grate system surface. The alternate rows which move in a reciprocating manner are supported by a moving structure providing the reciprocating motion. Attachment to either a fixed or moving guide is made at the back part of the grate blocks which is located below the prior overlapping block.

The grates are arranged on modular parallel lanes in the direction of fuel flow and are constructed in several modules across the unit width. Individual modules typically are considered as being arranged in zones relating to the combustion sequence, numbered in the direction of fuel flow, and each has its independent air supply. This accommodates the varying combustion sequences which include drying and ignition, main combustion and burnout which occur as the fuel travels from zone to zone. Each zone is usually two or three modules across the furnace width by five modules in the direction of fuel flow down the grate. Each module is usually made up of eight rows of grate blocks with each row having 24 individual grate blocks. Each module also has a press plate located at and defining each of its lateral sides. Furnace units operating with such prior art grate blocks have experienced excessive grate system maintenance and a degradation in combustion performance over a narrow time frame.

In grate modules using a prior art grate block, air distribution below the fuel bed is typically provided by two ½" round holes located in the leading face of each individual grate block. The air would be provided at a positive pressure from a fan to a plenum below the grates, and actual distribution to the fuel bed would be through these holes in the grate blocks directly to the refuse being transported and combusted. Actual experience defined a consistent pattern that after a 12–14 week operational period, approximately 90% of the air holes were plugged causing improper combustion and a lack of cooling of the grates. The plugging would be most severe in the center area, across the width of the grate system, where combustion demands are the most severe due to inherent heavier fuel bed loadings. Resultant actual air distribution would be excessive along the side walls with short circuiting causing clinkering and limiting the ability of the furnace unit to remain in service.

Another important consideration in achieving even air distribution across the grate system is proper sealing between grate modules and along the side walls of the furnace unit adjacent to the grate modules. Without proper scaling, channeling occurs with the associated problems noted above relative plugging of the air hole in the grate blocks.

In this regard, it is first noted that each grate module operates as a controlled and independent unit relative to the adjacent modules. Maintaining the alignment of each row of grate blocks within a module requires that the grate blocks fit tightly side by side. The tight fit also contributes to proper air distribution. The tight fit is usually accomplished by a pair of tension rods located below each row of grate blocks. In reciprocating rows, each rod is attached at one end to one of the end grate blocks in such rows (e.g. the 1st or 24th block). In stationary rows, each rod is respectively attached to a corresponding one of the two press plates which define the lateral sides (relative to refuse flow) of each module. This rod is essentially a rod with a turnbuckle at the other end thereof located about midway in each row to allow tightening to a pre-determined torque to provide the desired tension during operating conditions. However, the tension rod is therefore manually fixed to the pre-determined tension while the unit is in the cold condition. During operation, the rod is cooled by combustion air flowing beneath the grate, while the grate is subjected to temperatures relative to the fire above. Accordingly, the tension rods exhibited great sensitivity to the various conditions including original manual tensioning errors and differential temperature and expansion conditions occurring during operation and shutdown of the furnace and the transition therebetween. Failure of this tension rod would cause the entire row of grate blocks to lift and require a shutdown to repair.

A design called the sidewall grate roof elements and grate sidewall seals provide for the sealing between the modules adjacent the furnace sidewalls and the respective furnace sidewall. The purpose of this roof element and particularly the grate sidewall seal is to provide a seal for combustion air which flows through the grate system. The roof element and grate sidewall seals located at the junction of the grate system and the lower furnace sidewall must accommodate both grate system expansion as well as furnace expansion. The grate sidewall seal itself initially remains in a fixed position relative to the associated press plate. However, during operation, the lower furnace moves due to expansion approximately ½" in a horizontal direction away from the seal and roof element creating a gap between the roof element and the side wall. The prior art design allowed a foreign material (e.g. ash and refuse) to lodge in this area when the unit was operating (in a hot condition) and subsequent failures of this seal would occur when cycling the unit between operating and shutdown conditions. The lodged foreign material impeded the return of the seal to its original position during the shutdown condition. Eventually, the lodged foreign material would "push" the seal out of position breaking the seal, i.e. a sealing condition could not be maintained, causing channeling and associated air distribution problems.

Similarly, grate roof elements are installed between the press plates of adjacent grate modules. However, different types of sepals are used which are rope-like in configuration and are inserted into grooves in the outward face of the press plates. The seals in this position seal against the vertical sides of the grate roof elements. Accordingly, the seal problem noted above is not present between modules. However, the grate roof elements, including the sidewall grate roof elements, are attached to the respective module supporting structure by a yoke and pin arrangement. If for any reason maintenance was necessary on these elements, e.g. replacement due to wear or breakage, the grate modules adjacent to the affected grate roof elements would have to be disassembled and the grate blocks adjacent thereto removed to gain access to the yoke and pin assembly to effect replacement thereof.

Therefore, a need exists to alleviate or eliminate the foregoing problems associated with the design of component parts of the grate combustion system.

SUMMARY OF THE INVENTION

Accordingly, the present invention provides an improved grate block which alleviates or eliminates plugging of the air holes in the leading face of the grate block, wherein the improvement comprises a teardrop relief in the leading face of the grate block at the lower edge associated with each of the air holes such that when the grate block is in its installed position the upper edge associated with each air hole protrudes horizontally in the direction of refuse flow beyond the vertical plane intersecting the lower edge of the associated air hole and perpendicular to the direction of refuse flow, wherein the lower edge also corresponds to the uppermost edge of the teardrop relief. A further improvement to the grate block is vertically elongating the air holes thereof, e.g. such that the air holes are substantially oval-shaped e.g. a ½" wide by 1" high oval-shaped air hole. Initial experimental test installations were made in the critical central areas over about 10% of a grate system in two operating facilities. Results based on consistent operational time proved that air hole pluggage was reduced to approximately 10–15% or less of the available air hole cross-sectional area and grate block temperatures dropped from about 200° F. to about 300° F. to acceptable design levels. Continuing experimental tests in actual operations have reinforced the initial experimental test results. An additional improvement to the grate block is to flare the air holes from the leading face of the grate block to the interior and opposing surface thereto such that the opening of the air hole in the interior surface is larger than the opening of the same air hole in the leading face.

The present invention also provides a grate tension bar comprising a first section with means for connecting to a side wail end grate block on a first end thereof, a second section with means for connecting to a tensioning means on a first end thereof, and a spring section with a first end connected to the second end of the first section and a second end connected to the second end of the second section. The tension rods of the present invention accommodate normal operational variations and was insensitive to slight changes in movement or original settings, which previously would have catastrophically ruptured the prior art tension rod and would have then required the shutting down of the entire unit for replacement thereof.

The present invention further provides an improvement to a grate system having a plurality of grate modules each with an associated grate module support frame, wherein each grate module has a grate side wall seal element having at least two horizontally spaced bulbs and at least one side wall roof element, wherein the seal element is attached to the grate module support frame and is in contact with a furnace side wall, the improvement comprising a flexible metal plate extending the length of the respective seal element, the plate comprising an attachment portion, a flexing portion and a seal retaining portion with the flexing portion being intermediate of the attachment portion and the retaining portion, wherein the attachment portion is attached to the respective grate module frame, the retaining portion in an installed position contacts the seal element at a location intermediate the at least two bulbs with the flexing portion urging the retaining portion toward the seal element to maintain contact with the seal element in the installed position. In experimental tests in operating facilities, this plate maintained the integrity of this area under a variety of operating conditions and failures such as experienced by prior art seals have not subsequently occurred.

The present invention further provides an improvement to a grate system having a plurality of grate modules each with an associated grate module support frame and a plurality of grate roof elements located between the lateral sides of adjacent grate modules and between the furnace side wall and the lateral side of the grate module adjacent thereto, wherein each of the grate roof elements has a roof section forming the top thereof and a vertical portion extending downwardly from the roof section and each of the grate roof elements is attached to the respective grate module support frame via an attachment element having an upper yoke portion to which the vertical portion is attached when the grate roof element is in an installed position and a base portion which is attached to the grate module support frame in an installed position, the improvement comprising the yoke portion having a first support, preferably a pin transversing the open portion of the yoke, and a second support, preferably at least one nub protruding into the open portion of the yoke portion, and the vertical section having a first support engaging means which releasably engages the first support, preferably a horizontal slot in the vertical portion extending from a first vertical edge of the vertical portion wherein the horizontal slot slidably engages the first support, and a second support engaging means which is horizontally spaced from the first support engaging means and releasably engages the second support, preferably a nub receiving means, e.g. a hole or recess in the vertical face of the vertical portion. The first support may be a roll pin press-fitted into existing holes in the yoke portion previously used for attaching prior art grate roof elements, or solid pins or bolts otherwise affixed. Stated more particularly, the first support engaging means includes a horizontal slot which is slip-fitted to a mounting pin which transverses the open portion of the yoke portion, and the second support engaging means includes a hole in the vertical portion which releasably receives a nub protruding into the open portion of the yoke from an interior surface thereof which when the grate roof element is pressed down the nub is slip-fitted into the hole to provide a snapped-in-position friction fit. In practice, the first support engaging memos is attached first, and then the grate roof element is rotated downwardly around the mounting pin acting as a pivot point. The second support engaging means, e.g. a hole, is fabricated and located on (or in) the vertical portion of the grate roof element in such a way that as the grate roof element is rotated about the mounting pin, the nub makes contact with the lower edge of the vertical portion, and as further pressure is applied downwardly to the grate roof element, the sides or arms of the yoke portion are urged apart until the nub engages the hole in the vertical portion of the grate roof element and the nub is frictionally fitted and snapped into position in its corresponding hole. Attachment is therefore quite simple because the grate roof element is essentially self-positioning, no tools are required, and the yoke portion is so constructed that hand pressure is sufficient to achieve the desired friction fit. The width of the horizontal slot is approximately the same as the diameter of the mounting pin for providing a slip-fit to the mounting pin. The sides or arms of the yoke portion provide the force necessary for a firm friction fit between the nub receiving means in the vertical portion and the hubs in the arms of the yoke portion. Further, the vertical portion may also include positioning means for positioning the vertical portion over the nubs prior to attachment thereof with the nub receiving means. In a preferred embodiment, the positioning means is a notched surface located at the bottom edge of the vertical portion below the nub receiving means. Once the horizontal slot has slidably engaged the mounting pin, the notched surface centers the hubs and the hub receiving means located therein as the grate roof element is rotated downward around the mounting pin located in the horizontal slot. The notched surface allows the vertical portion to be attached quickly because great care need not be taken to position the vertical portion with extreme accuracy. If, for example, the horizontal slot is not completely slipped into place over the mounting pin, the positioning means will both center the hub receiving means over its corresponding nubs and push the horizontal slot toward its corresponding mounting pin. Further, the notched surface may be beveled in the nature of a wedge to aid in urging the yoke arms apart.

The present invention provides an improved side wall end grate block on a stationary row, wherein the grate block has a first side which is adjacent to a press plate and a second side which is adjacent to a grate block, the improvement to the side wall end grate block comprises a press plate attachment means on the first side and a tension rod attachment means on the second side. The press plate attachment means comprises a plurality of holes through the first side each of which may receive a bolt which is then received by a corresponding hole in the respective press plate to effect attachment of the end grate block to the press plate. The tension rod attachment means is like that used in the end grate blocks in reciprocating rows.

In the prior art, the end grate blocks of stationary rows were immobilized by securing the tension rod to the respective press plate, much like the remaining grate blocks in the row. The improved side wall end grate block may be used in stationary or reciprocating rows. In the end grate blocks of the present invention, the tension rod would attach to the second side. In a stationary row, the first side of the end grate block would be attached to the press plate; and in a reciprocating row, the first side of the end grate block would not be attached to the press plate. Further, both types of attaching means could be placed on both sides of the end grate block such that it would have universal application to stationary or reciprocating rows and to the left or right side of a grate module. This reduces the number and types of spare parts required in inventory.

Accordingly, these and other objects, features and advantages of the present invention will become apparent to those skilled in the art, from a consideration of the following detailed description of preferred embodiments, wherein references made to the figures in the accompanying drawings.

In the Drawings

DESCRIPTION OF THE INVENTION

Figure 1:
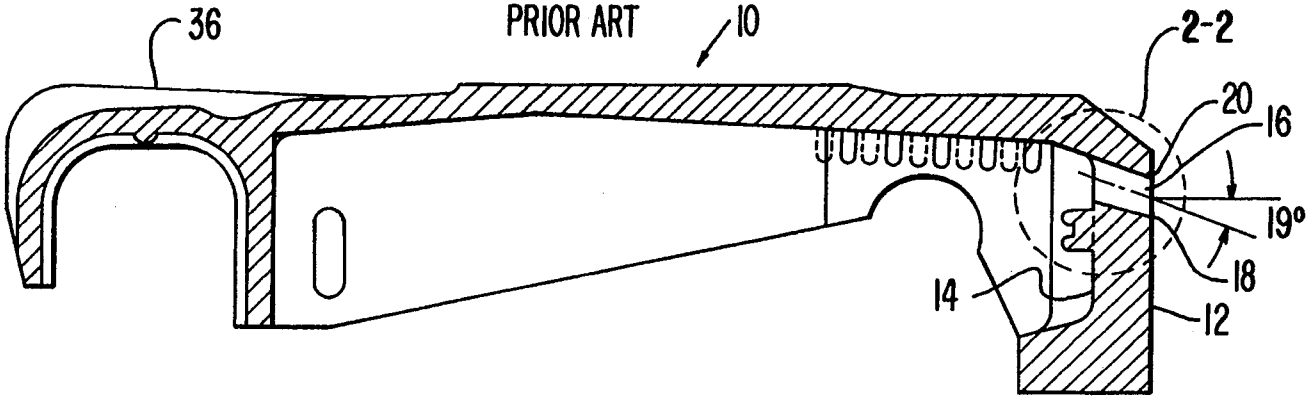
FIG. 1 PRIOR ART
FIG. 1 is a side elevation in cross section of a prior art grate block.

In referring herein below to the various figures of the drawings, like reference numerals will be utilized to refer to identical pans and features of the devices shown therein.

Figure 2:
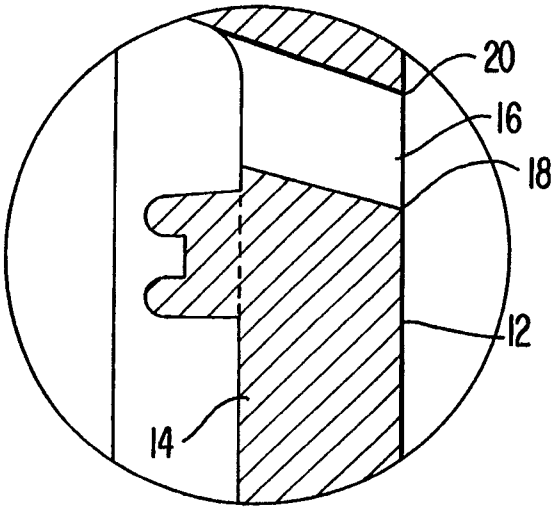
FIG. 2 PRIOR ART
FIG. 2 is a side elevation in expanded view in cross section of the portion of the grate block shown in FIG. 1 enclosed by the circle 2—2.

Referring now to the drawings, and more preferably to FIGS. 1 and 2, there is shown a grate block ten according to the prior art. The grate block 10 has a leading face 12 and a corresponding interior and opposing surface 14. There are a pair of air holes 16 (only one of which is apparent in FIGS. 1 and 2) which extends from the leading face 12 to the interior and opposing surface 14. The air hole 16 has a major axis which is angled by about 19° relative to horizontal. Typically, in a grate module 30, the grate blocks 10 are inclined by about 18° relative to horizontal. Accordingly, when combustion air exists the air holes 16, the combustion air is exiting in a horizontal direction. See FIG. 3. As can be more clearly seen in FIG. 3, when the grate blocks 10 are in an installed position, the lower edge 18 protrudes beyond the upper edge 20 of the air hole 16. Accordingly, during combustion non-combustible materials which melt at the temperatures experienced within the furnace are caught on this protrusion and solidified. In a relatively short period of time, these materials will simply build up and plug the air holes 16 and cause the associated problems noted earlier. To unplug these holes 16 requires that the incinerator be shut down and a manually intensive effort with hammers and chisels is required to clean each of the holes 16 in the affected grate blocks 10.

Figure 4:
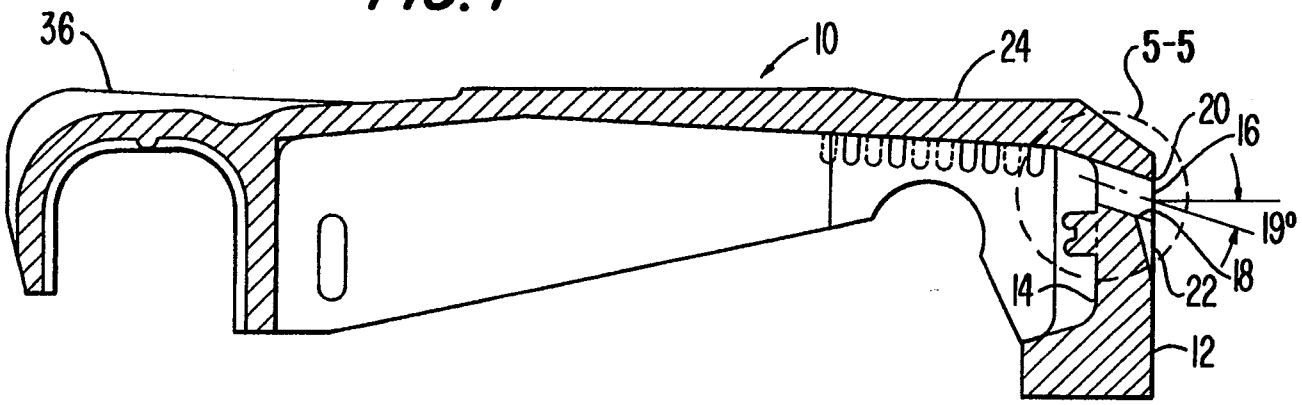
FIG. 4 is a side elevation in cross section of a grate module according to the present invention.
Figure 5:
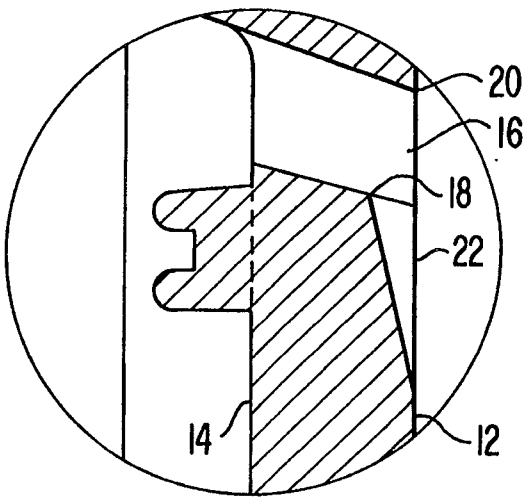
FIG. 5 is a side elevation enlargement of that portion of the grate block in FIG. 4 enclosed by the circle 5—5.

In FIGS. 4 and 5, there is shown a grate block 10 according to the present invention. A tear drop relief 22 is formed into the leading face 12 of the grate block 10. The tear drop relief 22 sets back the lower edge 18 of the air hole 16 such that it does not protrude beyond the upper edge 20 of the air hole 16 when the grate block 10 is in an installed position. Accordingly, when melted non-combustible materials drip over the upper edge 20, they are not caught by the lower edge 18 but rather fall into the tear drop relief 22 which directs these materials down the leading face 12 on to the upper surface 24 of the next respective grate block 10.

Figure 6:
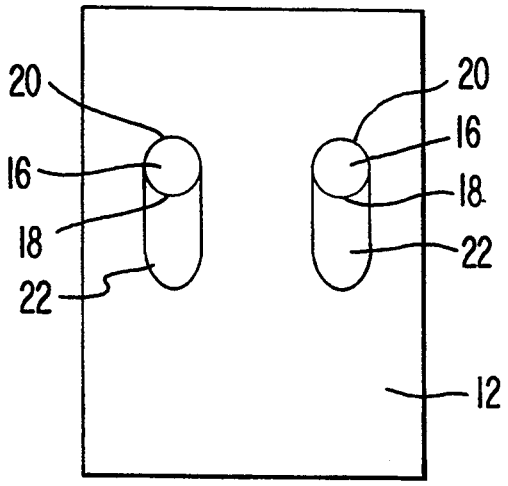
FIG. 6 is a front view of a grate block according to the present invention.

In FIG. 6, there is shown the leading face 12 of a grate block 10. Therein, each air hole 16 has a tear drop relief 22.

Figure 7:
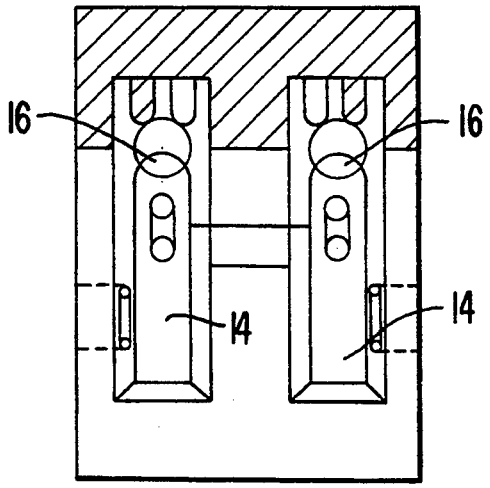
FIG. 7 is a rear view of the leading face of a grate block according to the present invention.

As shown in FIG. 7, an additional improvement to the grate block 10 is to flare the air holes 16 from the leading face 12 of the grate block 10 to the interior and opposing surface 14 such that the opening of the air hole 16 in the interior surface 14 is larger than the opening of the same air hole 16 in the leading face 12.

Figure 8:
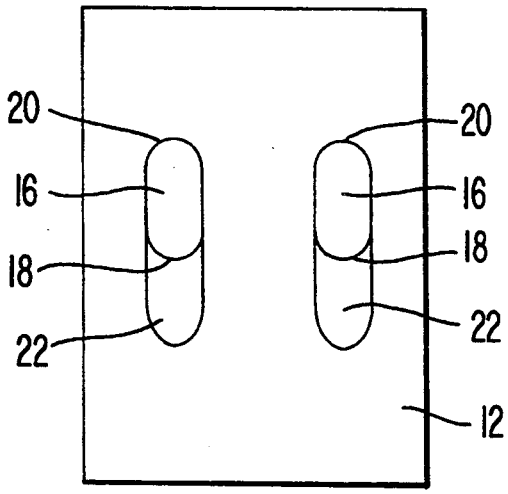
FIG. 8 is a front view of a grate block according to the present invention.
Figure 9:
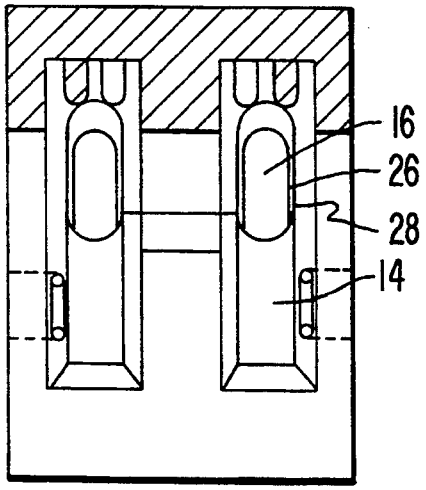
FIG. 9 is a rear view of the leading face of a grate block according to the present invention.

In FIG. 8, there is shown a leading face 12 with an elongated air hole 16 with a tear drop relief 22. As shown in FIG. 9, the air hole 16 may also be flared from the leading face 12 to the interior and opposing surface 14 similar to that shown in FIG. 7, however utilizing the elongated air holes 16 of FIG. 8. Accordingly, the opening 26 of the air hole 16 is smaller in the leading face 12 than the opening 28 of the same air hole 16 in the interior surface 14. Having the flared surface in the air holes 16 makes it easier to chisel out the solidified non-combustible materials which may accumulate in the air holes 16.

Figure 3:
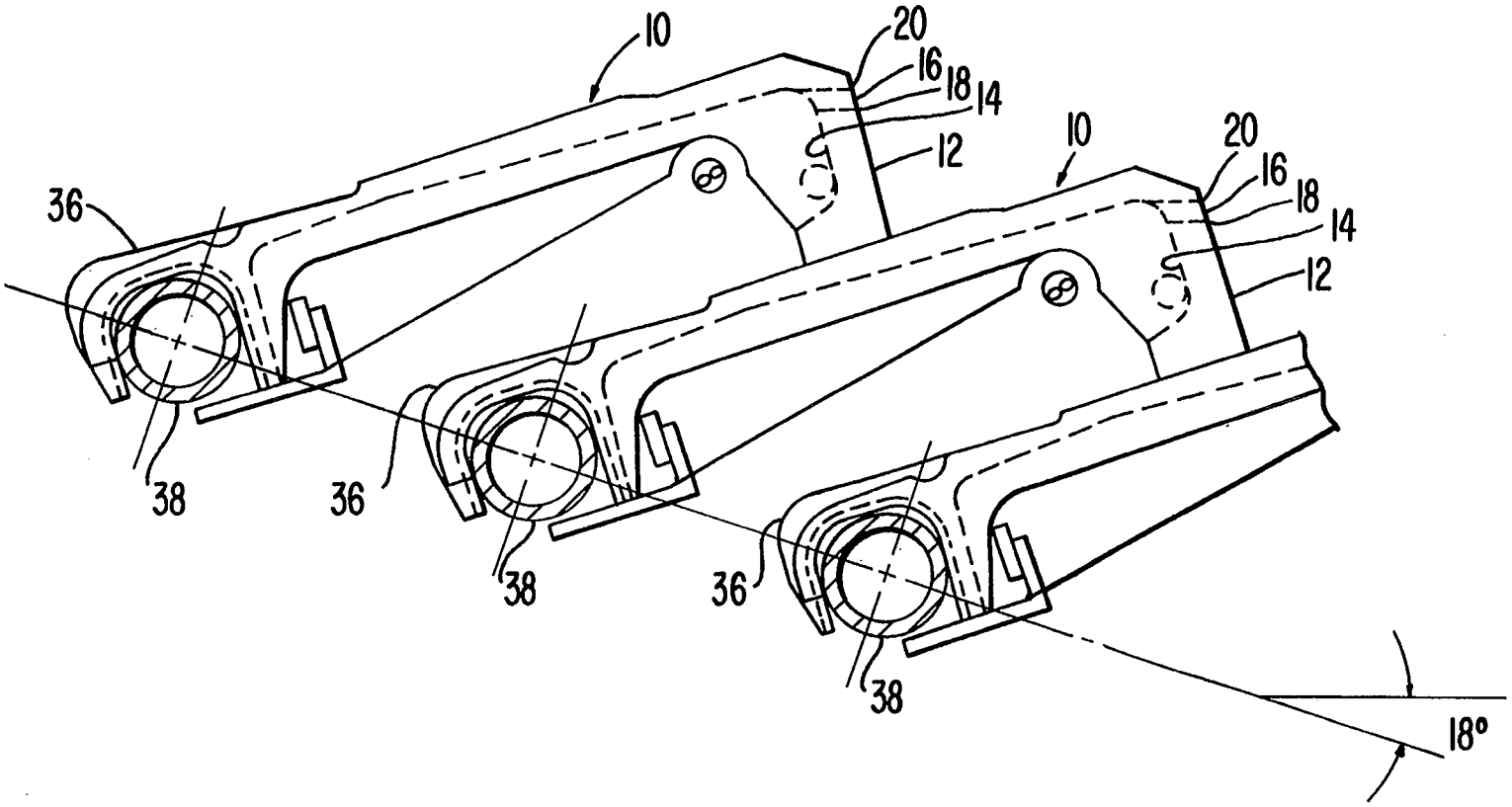
FIG. 3 PRIOR ART
FIG. 3 is a side elevation of a portion of a prior art grate module.
Figure 10:
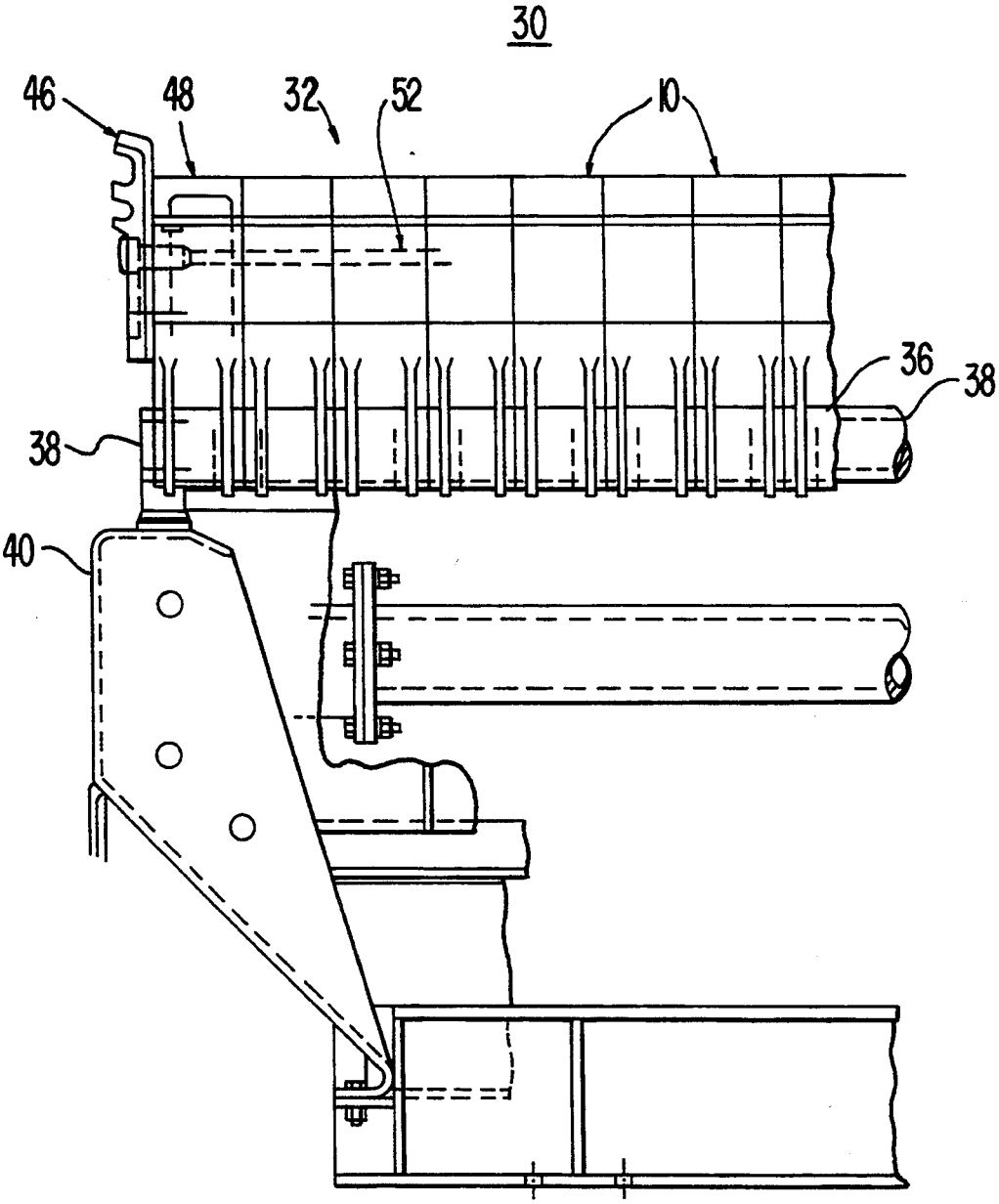
FIG. 10 PRIOR ART
FIG. 10 is a partial depiction of a grate module showing a stationary row of grate blocks according to the prior art.
Figure 11:
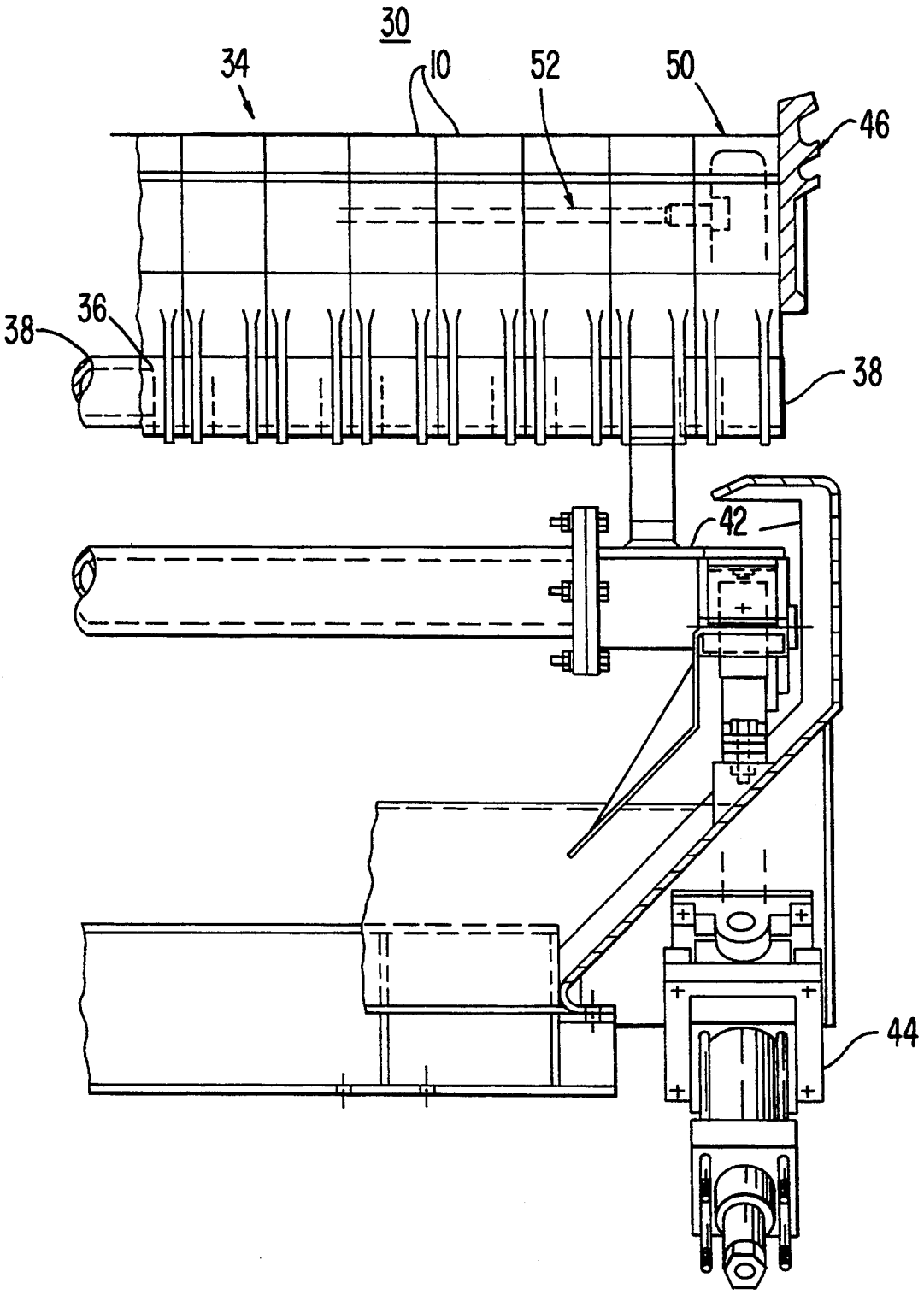
FIG. 11 PRIOR ART
FIG. 11 is a partial depiction of a reciprocating row of a grate module according to the prior art.

Referring now to FIGS. 10 and 11, there are shown portions of a grate module 30 showing a stationary row 32 of grate blocks 10 in FIG. 10 and a reciprocating row 34 of grate blocks 10 in FIG. 11. The rear portion 36 of the respective grate blocks 10, more clearly shown in FIG. 1, 3 and 4, is engaged with a support bar 38. In a stationary row 32, the support bar 38 is anchored to an associated grate module support frame 40. In a reciprocating row 34, the support bar 38 is affixed to a support member 42 which in turn is attached to a reciprocating mechanism 44. Each grate module 30 has a pair of press plates 46 which define its lateral edges. Adjacent to each of the respective press plates 46 is a side wall end grate block 48 and 50, one type for a stationary row 32 and a different type for a reciprocating row 34, respectively. To provide an air seal between grate blocks 10 and the respective end blocks 48 and 50, a tension rod 52 is utilized. As shown in FIG. 10, in a stationary row 32, the tension rod 52 extends through the end grate block 48 and is attached to the press plate 46. As shown in FIG. 11, in a reciprocating row 30, the tension rod 52 is attached to the end grate block 50.

Figure 12:
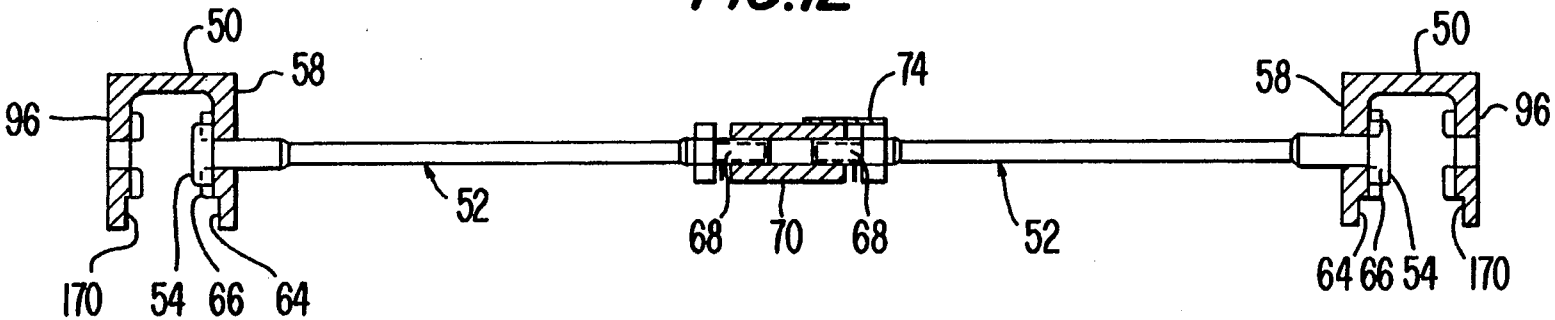
FIG. 12 is a partial cross section of a row in a grate module depicting a prior art tension rod assembly with end grate blocks according to the present invention.
Figure 14:
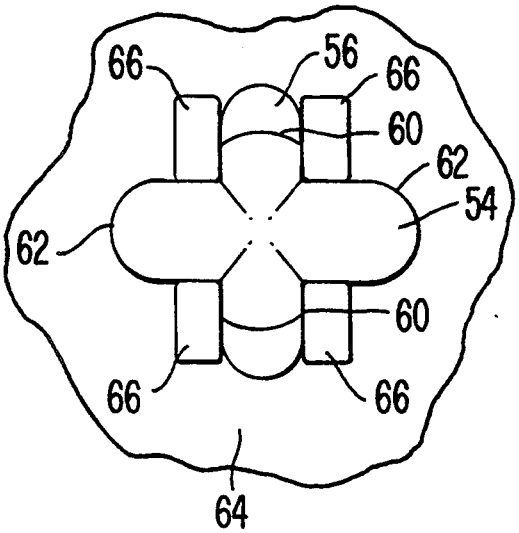
FIG. 14 PRIOR ART
FIG. 14 is like FIG. 13 with the head portion of a tension rod in its installed position.
Figure 15:
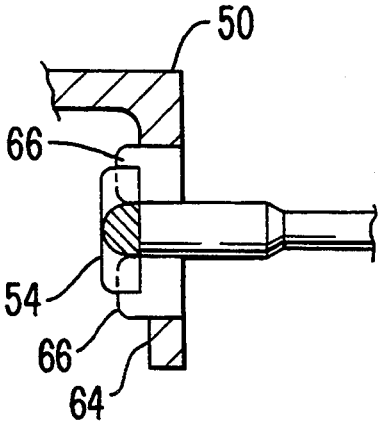
FIG. 15 PRIOR ART
FIG. 15 is a partial cross section oriented parallel to the axis of the tension rod focusing on the connecting point of the tension rod to the end grate block.

Referring now to FIG. 12 through FIG. 15, more particularly to FIG. 12, there are shown two tension rods 52 each attached to an end grate block 50 of a reciprocating row 34. The head end 54 of the tension red has a cross shape as shown in FIG. 14. The head end 54 is inserted through a similar cross-shaped hole 56 in a side 58 of the end grate block 50. Once the head end 54 of the tension rod 52 is inserted through the hole 56, the tension rod is rotated 90°. It is noted that the head end 54 has two opposing short extensions 60 and perpendicular thereto are two long extensions 62. Accordingly, once the head end 54 is rotated 90°, the long extensions 62 rest on an interior surface 64 of side 58. In this resting position, the long extensions 62 and short extensions 60 fit between four appropriately spaced locking protrusions 66 which extend perpendicularly from the interior surface 64. The opposite end of the respective tension rod 52 has a threaded portion 68 which engages a turn buckle 70. The turn buckle 70 is turned to increase or decrease the tension across the tension rod 52. It is noted that the threaded portions 68 of opposing tension rods engaging the same turn buckle are oppositely threaded so that a turn of the turn buckle 70 will result in tightening or loosening respectively both tension rods 52 at the same time. Adjacent the threaded portion 68 is a nut-like portion 72 which is used in conjunction with strip 74 as a locking assembly to keep the turn buckle 70 from loosening once the desired tension on the tension rods 52 is attained.

Figure 16:
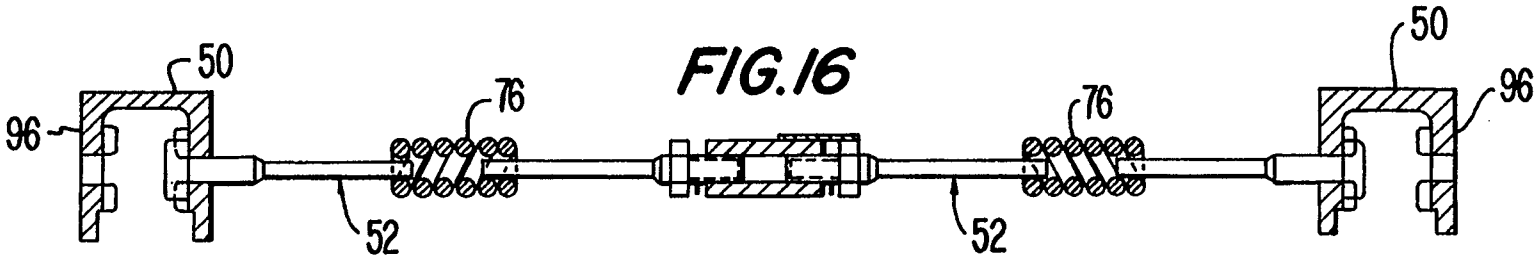
FIG. 16 is like FIG. 12 with the exception of showing a tension rod according to the present invention.
Figure 13:
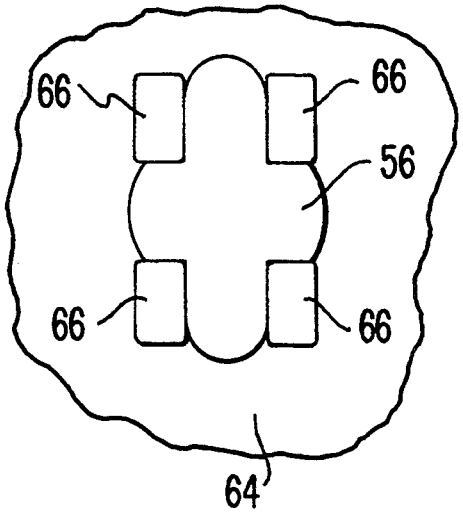
FIG. 13 PRIOR ART
FIG. 13 is a partial side elevation of an interior surface of an end grate module showing the locking protrusions and cross-shaped hole for inserting the head portion of a tension rod.

Referring now to FIG. 16, a tension rod 52 according to the present invention is like the tension rod 52 of the prior art shown in FIG. 12; however, a mid-section of each rod 52 is replaced with a spring-section 76 to better accommodate errors in torque and varying conditions in plant operations which may slowly or abruptly change the tension on the respective tension rods 52. It is further noted that the tension rods 52 are typically torqued during a shutdown and are therefore cold. Typically, the tension rod 52 is cooled by the combustion air prior to exiting the air holes 16 in the grate blocks 10 or the end grate blocks 48 or 50. However, if combustion air flow is impeded, the tension rods 52 may be exposed to inordinate heat causing dramatic changes in tension across the respective tension rods 52. The spring section 76 is designed to compensate for such variability in operating conditions and errors in initial torquing.

Figure 17:
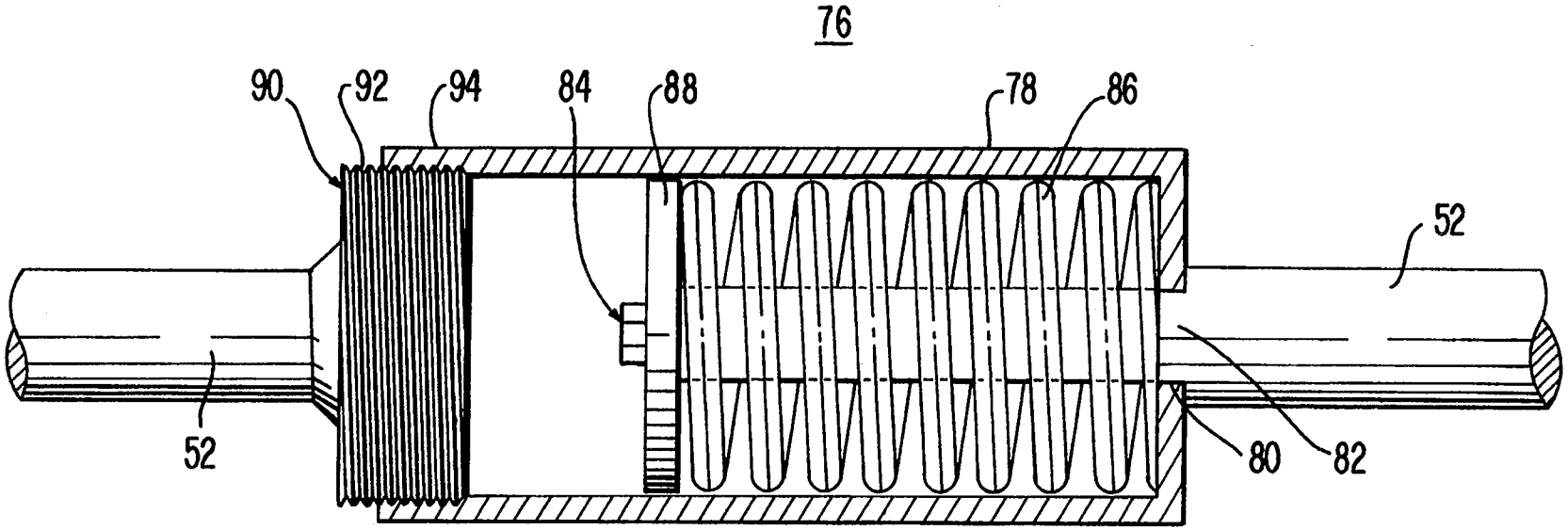
FIG. 17 is an alternate embodiment of the spring section utilized in the tension rod of the present invention.

An alternate embodiment of the spring section 76 is shown in FIG. 17. The spring section 76 shown in FIG. 17 is substituted for the spring section 76 shown in FIG. 16. Accordingly, to one end of the tension rod 52 is attached a spring housing 78 having a hole 80 axially aligned with the spring housing. Through hole 80 is inserted a section 82 of tension rod 52 having a reduced diameter corresponding to slightly smaller than that of hole 80. The end portion of section 82 is drilled and tapped for received a bolt 84. With the section 82 inserted into the spring housing 78 through hole 80, a spring 86 is inserted into the spring housing 78. A washer 88 is butted against the opposite side of the spring 86 and a bolt 84 is inserted through the washer 88 and threadily engages the tapped and threaded portion of section 82. The bolt 84 is tightened until the washer 88 rests on the end portion of section 82. The opening in the spring housing opposite hole 80 is threaded on its interior surface 94. The remaining portion of the tension rod 52 has a section 90 which is cylindrical and coaxial with the tension rod. Section 90 is of a greater diameter than the tension rod 52. The outer circumference 92 of the section 90 is threaded so as to mate with the threaded portion 94 of the spring housing 76. The tension rods 52 of the present invention shown in FIGS. 16 and 17 are tensioned or torqued in a similar fashion to the prior art tension rod 52 shown in FIG. 12.

Figure 18:
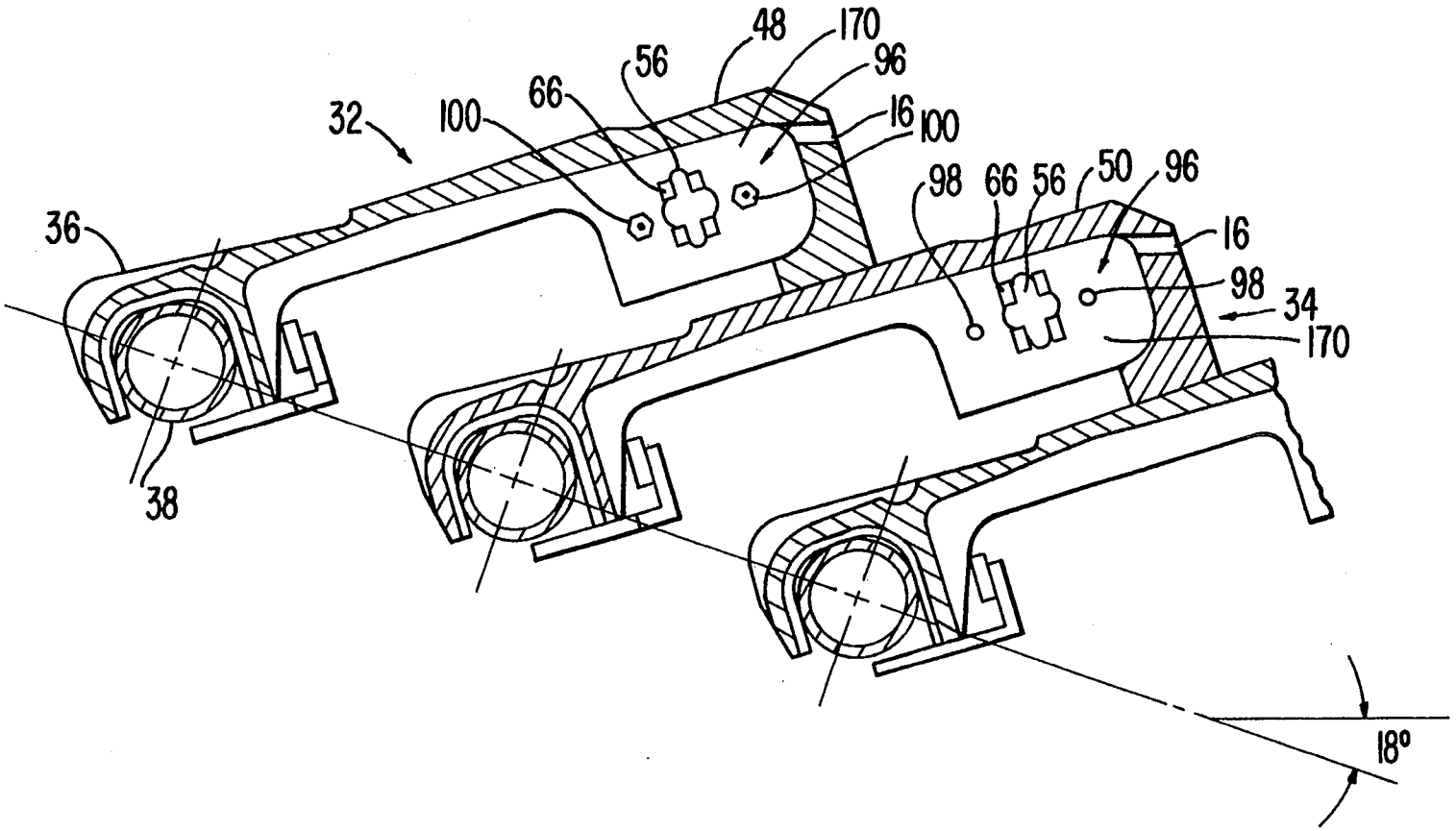
FIG. 18 is a partial side elevation in cross section of end grate modules according to the present invention.

Referring now to FIG. 18 in conjunction with FIGS. 12 through 16, the present invention is also directed to improved end grate blocks 48 and 50, both of which are the same in the preferred embodiment shown in FIG. 18. Thus, as noted in regards to FIG. 10 and 11, the prior art required at least two types of grate end blocks and as many of four types of grate end blocks. Distinctions were made between left and right side end grate blocks 48 for a stationary row 32 and for left and fight side end grate blocks 50 for a reciprocating row 34. For a stationary row 32, the tension rod 52 was attached to the press plate 46. In a reciprocating row, the tension rod 52 was attached to the end grate block 50. In the present invention, the tension rod 52 is attached to the end grate block 48 or 50 in the same fashion as the grate end block 50 shown in FIG. 11. As shown in FIGS. 12 and 16, the end grate blocks 50 (or 48) have the cross-shaped hole 56 and locking protrusions 66 on the inside surfaces 64 of the inward side section 58 and on the inside surface 170 of the outward side section 96. Also in side sections 58 and 96 of the respective end grate block 48 or 50, there are a pair of holes 98 which align with corresponding holes (not shown) in the press plate 46 (not shown). Bolts 100 are inserted into holes 98 and the corresponding holes in the press plate for attaching the end grate block 48 of a stationary row 32. In a reciprocating row 34, the end grate block 50 is not attached to the respective press plate 46. Accordingly, in FIG. 18 holes 98 are not used in a reciprocating row. Further, whether the row be a stationary one 32 or a reciprocating one 34, the tension rod head portion 54 is attached to the end grate block 48 or 50 in the manner shown in FIGS. 12 and 14–16. Accordingly, a single design end grate block accommodates either right or left-hand positioning and use on either a stationary or reciprocating row. If differentiation between a stationary, or reciprocating end grate block is desired, the holes 98 may be omitted; and, further if a distinction between fight and left side is desired, the cross-shaped hole 56 and associated locking protrusions 66 may be located only on the desired side of the respective end grate block.

Figure 20:
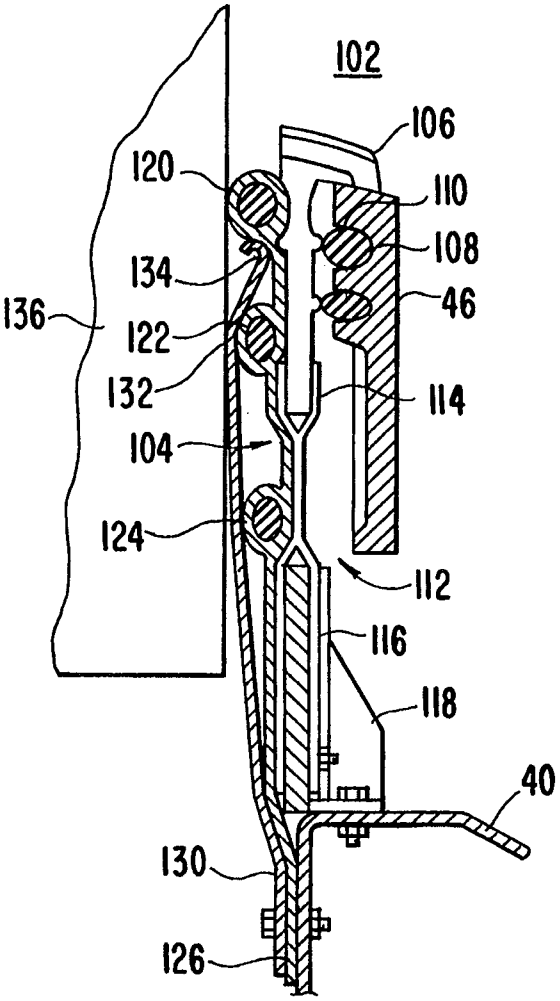
FIG. 20 is like FIG. 19 showing the side wall sealing assembly in an installed position adjacent to a furnace sidewall.
Figure 19:
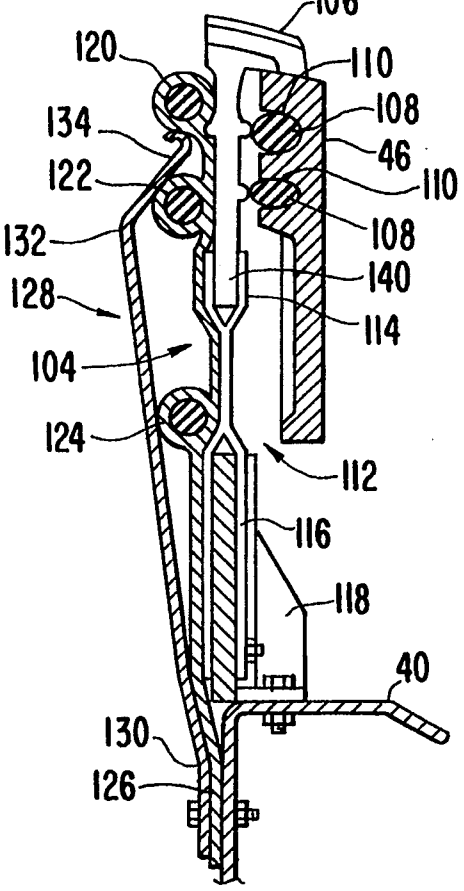
FIG. 19 is a sidewall sealing assembly incorporating a flexible plate according to the present invention.

Referring now to FIGS. 19 and 20, there is shown a sidewall sealing assembly 102 according to the present invention. The sidewall sealing assembly 102 has a grate sidewall seal element 104, a sidewall roof element 106 and a press plate 46 with two rope-like sealing elements 108 inserted in grooves 110 of the press plate 46. The grate roof element 106 is supported by an attachment element 112. The attachment element 112 has an upper yoke portion 114 and a lower yoke portion 116. The lower yoke portion 116 is attached to a base portion 118 which in turn is attached to the associated grate module support frame 40. The sidewall seal element 104 in this embodiment has three bulbs, 120, 122 and 124 respectively. The lower portion 126 of the sidewall seal element 104 is attached to the grate module support frame 40. The sidewall sealing assembly 102 further has a flexible metal plate 128 which extends the horizontal length of the sidewall seal element 104. The plate 128 has an attachment portion 130, a flexing portion 132 and a seal retaining portion 134. The seal retaining portion 134 in an installed position contacts the seal element 104 at a location intermediate the bulbs 120 and 122 with the flexing portion 132 urging the retaining portion 134 toward the sealing element 104 to maintain contact with the seal element 104 in the installed position. The sidewall sealing assembly 102 shown in FIG. 19 is shown in FIG. 20 abutting a furnace sidewall 136. In this position, the furnace sidewall presses upon the flexing portion 132 which maintains the seal element 104 in its extended position as the retaining portion 134 urges bulb 120 upward and maintaining the seal between the furnace sidewall 136 and the sidewall roof element 106.

Figure 21:
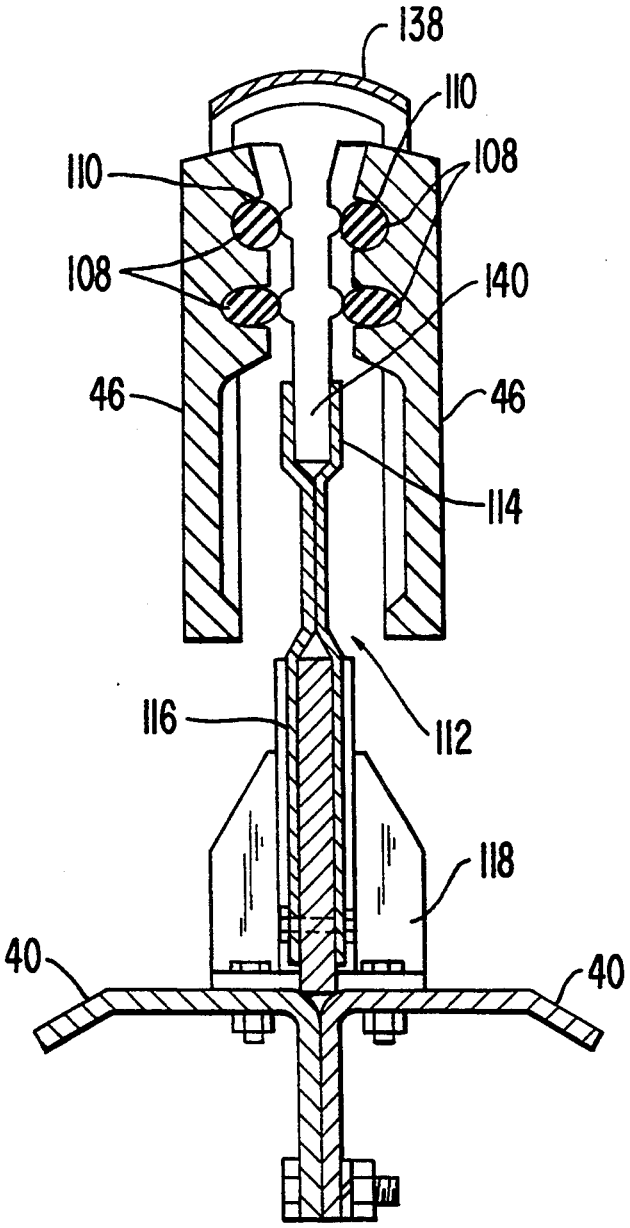
FIG. 21 is a grate roof element in an installed position without showing the end grate blocks on either side thereof.
Figure 22:
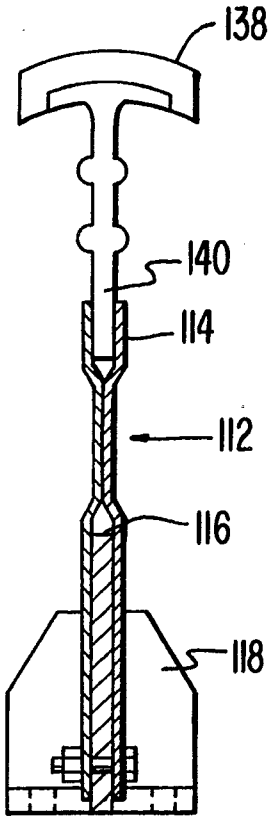
FIG. 22 is a grate roof element attached to an attachment element in partial cross section.

Referring now to FIG. 21, there is shown a grate roof element 138 in an installed position. Such grate roof elements 138 are installed between the lateral sides of grate modules 30 (not shown). Accordingly, in FIG. 21, the grate roof element 138 is installed between the press plates 46 of associated and adjacent grate modules 30 (not shown). Similar to the side wall roof element 106 shown in FIGS. 19 and 20, rope-like seals 108 are inserted in the grooves 110 in the press plate 46 to establish a seal between the grate roof element 138 and the respective press plates 46. The vertical portion 140 of the grate roof element 138 shown in FIG. 21 or of the sidewall roof element 106 shown in FIG. 19 is attached to the respective grate module support frame 40 by an attachment element 112. As earlier noted, the attachment element 112 has an upper yoke portion 114 and a lower yoke portion 116 which is attached to a base portion 118. The base portion 118 in turn is attached to the grate module support frame 40. As is readily apparent from FIGS. 19 through 21, when the side wall roof element 106 or grate roof element 138 are in an installed position, the vertical portion 140 which is attached to the upper yoke portion 114 is not approachable to effect replacement of the sidewall roof element 106 or of the grate roof element 138 without disassembling the grate modules 30 (not shown) adjacent thereto and removing the associated press plates 46 to gain access to the area where the vertical portion 140 is attached to the upper yoke portion 114 as shown in FIG. 22.

Figures 23, 24, 25, 26, 27:
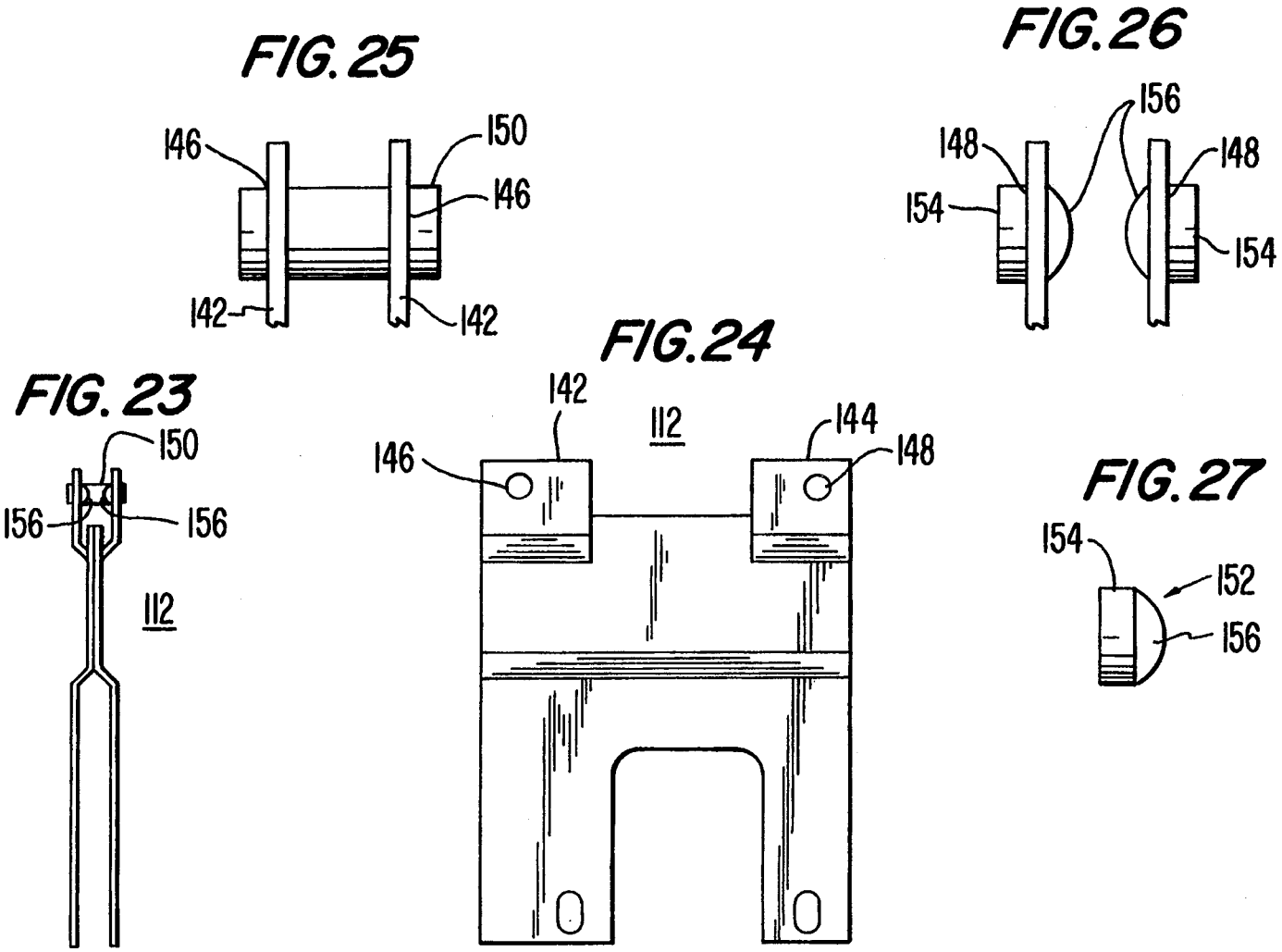
FIG. 23 is a front view of an attachment element according to the present invention.
FIG. 24 is a side elevation of an attachment element prior to modification according to the present invention.
FIG. 25 is a partial detail showing the mounting pin in an installed position in the attachment element shown in FIG. 23.
FIG. 26 is a detail of a portion of the attachment element shown in FIG. 23.
FIG. 27 is a detail of a nub used to modify the attachment element shown in FIG. 24 and shown in an installed position in FIG. 26.

To effect replacement of the sidewall roof element 106 or of the grate roof element 138 without disturbing or dismantling the grate modules 30 (not shown) and accomplishing same in a very short time frame, the vertical portion 140 and the attachment means in the upper yoke portion 114 have been modified. Referring now to FIGS. 23 through 27, the modifications to the attachment element 112 are described. FIG. 23 is a front perspective of the attachment element 112 according to the present invention and FIG. 24 is a side perspective of the attachment element shown in FIG. 23. In the present embodiment of the attachment element 112, the upper yoke portion 114 is separated into a first upper yoke portion 142 and a second upper yoke portion 144. In the prior art, each arm of the first upper yoke portion 142 and the second upper yoke portion 144 had holes 146 and 148, respectively, which aligned with the corresponding holes in the vertical portion 140 of the prior art sidewall roof element 106 or the grate roof element 138. Once the various holes were aligned, attachment means were inserted therethrough to attach the respective roof element 106 or 138 to the attachment element 112. However, according to the present invention, a mounting pin 150 is inserted through the holes 146 of the arms of the first upper yoke portion 142. The mounting pin 150 fits tightly in the holes 146. The mounting pin 150 may be a solid pin or a rolled pin. A rolled pin is constructed of a tube having a longitudinal slot cut through its entire length for providing radial spring pressure to the rolled pin.

Referring now to the second upper yoke portion 144, the holes 148 are each fitted with a "button" or nub 152 as shown in FIG. 27. Each nub 152 has a cylindrical portion 154 with a convex surface 156 on one end of the cylindrical portion 154. The nubs 152 are attached to the holes 148 of the second upper yoke portion 144 such that the respective convex surface 156 protrudes into the open area between the arms of the second upper yoke portion 144 as shown in FIGS. 26 and 23. The cylindrical portion 154 preferably fits tightly within the holes 148 for ease of attachment of the respective nub 152 to the second upper yoke portion 144.

Figure 28:
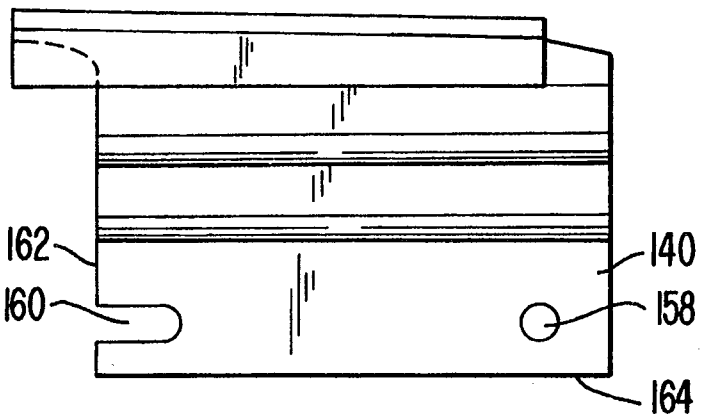
FIG. 28 is a side elevation of a grate roof element according to the present invention.

Referring now to FIG. 28, there is shown a grate roof element 138 according to the present invention. For the sake of convenience the following also applies to a sidewall roof element 106. The vertical portion 140 has a hole 158 therethrough. Horizontally spaced from hole 158 is a horizontal slot 160 which extends from vertical edge 162 of the vertical portion 140 and extends horizontally from the vertical edge 162 toward hole 158. The location of the horizontal slot 160 corresponds to the location of pin 150 in the attachment element 112; and likewise, the hole 158 corresponds to the location of the convex surface 156 of the nubs 152, when in an installed position.

For effecting the installation of the grate roof element 138 or sidewall roof element 106, the slot 160 is slip-fitted to the mounting pin 150. There then the grate roof element 138 or sidewall roof element 106 is rotated about the mounting pin 150 until the convex surfaces 156 of the nubs 152 make contact with the lower edge 164 of the vertical portion 140. Further pressure is applied downwardly to the grate roof element 138 or sidewall roof element 106. The additional pressure urges the sides or arms of the second upper yoke portion 144 apart and the lower edge 164 continues downwardly until the convex surfaces 156 engage the hole 158 in the vertical portion 140 of the grate roof element 138 or sidewall roof element 106. The nubs 152 are frictionally fitted and snapped into position in their corresponding hole 158, The width of the horizontal slot 160 is approximately the same as the diameter of the mounting pin 150 for providing a slip-fit to the mounting pin 150. The sides or arms of the second upper yoke portion 144 provide the force necessary for a firm friction fit between the hole 158 in the vertical portion 140 and the nubs 152.

Figure 29:
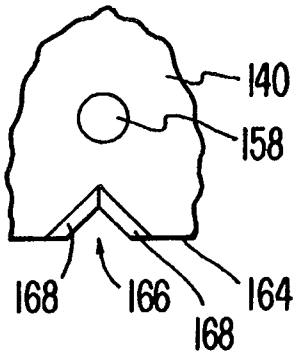
FIG. 29 is a partial side elevation of another embodiment of a grate roof element according to the present invention.

As shown in FIG. 29, the vertical portion 140 may also include positioning means for positioning the hole 158 over the nubs 152 prior to attachment thereof with the hole 158. The positioning means may be a notched surface 166 located on the lower edge 164 of the vertical portion 140 below the hole 158. Once the horizontal slot 160 has slidably engaged the mounting pin 150, the notched surface 166 centers the nubs 152 and the hole 158 as the grate roof element 138 or sidewall roof element 106 is rotated downward about the mounting pin 150. Further, the notched surface 166 may have bevelled edges 168 in the nature of wedge to aid in urging the arms of the second upper yoke portion 144 apart during installation or removal of the grate roof element 138 or sidewall roof element 106. To effect removal of such elements 106 or 138, the foregoing procedure is reversed.

Figure 30:
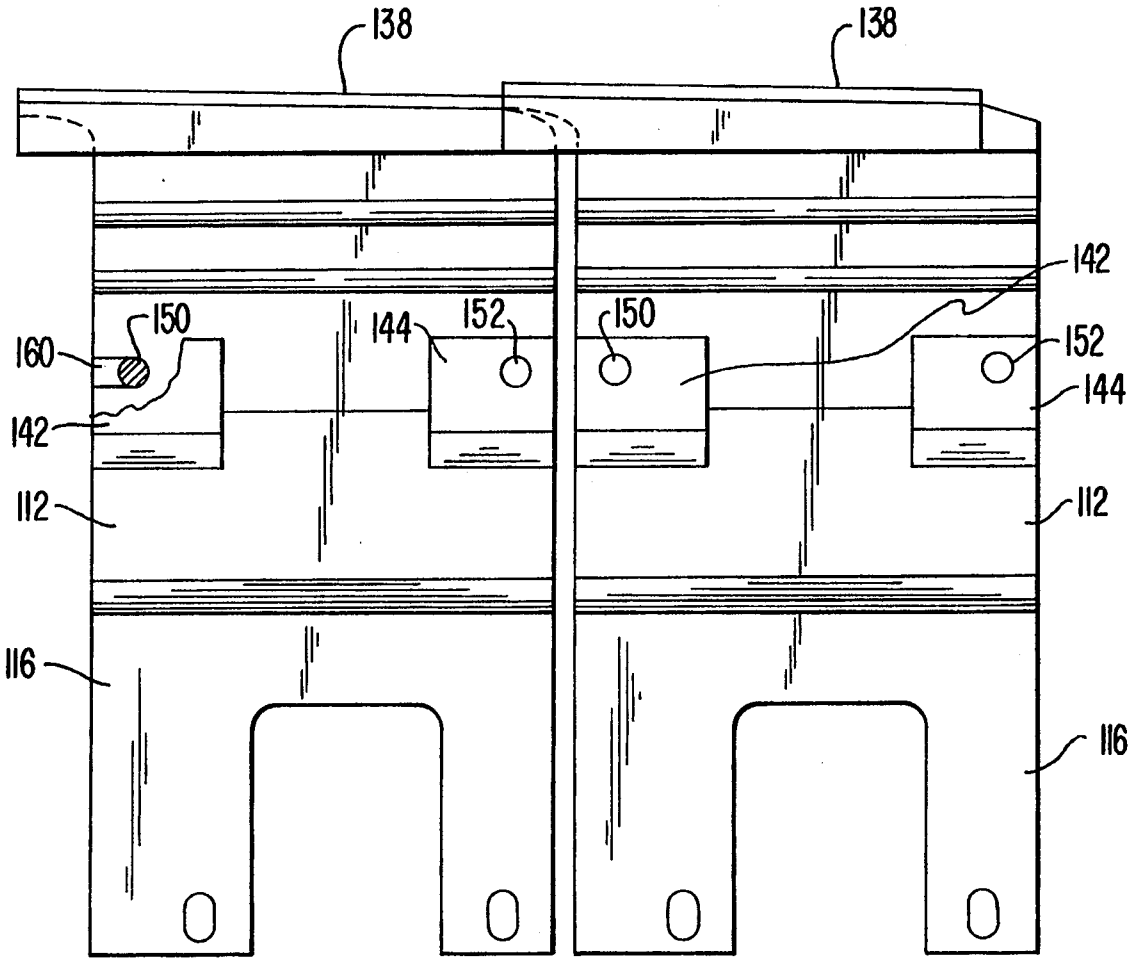
FIG. 30 is a side elevation in partial cross section showing two grate roof elements and attachment elements according to the present invention.

Referring now to FIG. 30, there are shown two grate roof elements according to the present invention installed in corresponding attachment elements 112 according to the present invention. In the first (on the left) attachment element 112, the first upper yoke portion 142 is partially cut away to expose the horizontal slot 160 slip-fitted over the mounting pin 150.

It is to be understood that the disclosed embodiments are merely illustrative of the principles of the present invention which could be implemented by other types of structures which would be readily apparent to those skilled in the art, for example by placing the convex surfaces 156 on the vertical portion 140 engaging holes 148 in the second yoke portion 144. Accordingly, the scope of the present invention is to be determined in accordance with the appended claims.

What is claimed is:

1. A grate tension bar comprising:

a first section with means for connecting to a side wall end grate block on a first end thereof, a second section with means for connecting to a tensioning means on a first end thereof, and a spring section with a first end connected to the second end of the first section and a second end connected to the second end of the second section.

2. In a grate combustion system having a plurality of grate modules each with an associated grate module support frame, wherein each grate module has a grate side wall seal element having at least two horizontally spaced bulbs and at least one side wall roof element, wherein the seal element is attached to the grate module frame and is in contact with a furnace side wall, the improvement comprising a flexible metal plate extending the length of the respective seal element, the plate comprising an attachment portion, a flexing portion and a seal retaining portion with the flexing portion being intermediate of the attachment portion and the retaining portion, wherein the attachment portion is attached to the respective grate module support frame, the retaining portion in an installed position contacts the seal element at a location intermediate the at least two bulbs with the flexing portion urging the retaining portion toward the seal element to maintain contact with the seal element in the installed position.

3. A side wall end grate block, wherein the grate block has a first side which is adjacent to a press plate and a second side which is adjacent to a grate block in an installed position, wherein said side wall end grate block comprises a press plate attachment means on the first side and a tension rod attachment means on the second side.

4. The side wall end grate block of claim 3, wherein the press plate attachment means comprises a plurality of holes through the first side, wherein each of the plurality of holes is adapted to receive a bolt which is then received by a corresponding hole in the respective press plate to effect attachment of the end grate block to the press plate.

5. The side wall end grate block of claim 3, wherein the tension rod attachment means includes a cross-shaped hole through the second side and locking protrusions for accepting and preventing movement of a head end of a tension rod.

6. The side wall end grate block of claim 4, wherein the tension rod attachment means includes a cross-shaped hole through the second side and locking protrusions for accepting and preventing movement of a head end of a tension rod.

7. The side wall end grate block of claim 6, wherein said first side includes inside and outside surfaces and said second side includes inside and outside surfaces, said inside surface of said first side facing said inside surface of said second side.

8. The side wall end grate block of claim 7, wherein said inside surface of said second side includes said locking protrusions.

9. The side wall end grate block of claim 8, wherein said inside surfaces of both said first and second sides include: locking protrusions and wherein both said first and second sides include a plurality of holes, enabling the side wall end grate block to be adaptable for installation on either the right or left hand ends of a row of grate blocks.

10. The side wall end grate block of claim 9, wherein said side wall end grate block is also adaptable for installation on both stationary and reciprocating rows of grate blocks.

11. The side wall end grate block of claim 3, wherein said side wall end grate block is adaptable for installation on stationary and reciprocating rows of grate blocks.

* * * * *